US007049737B2

(12) United States Patent
Kamiguchi

(10) Patent No.: US 7,049,737 B2
(45) Date of Patent: May 23, 2006

(54) ANODE-TERMINAL COVER AND DISPLAY HAVING THE SAME

(75) Inventor: Kinya Kamiguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 10/726,548

(22) Filed: Dec. 4, 2003

(65) Prior Publication Data

US 2004/0127094 A1 Jul. 1, 2004

(30) Foreign Application Priority Data

Dec. 27, 2002 (JP) ..... 2002-380254

(51) Int. Cl.
*H01J 29/92* (2006.01)
*H01R 11/21* (2006.01)

(52) U.S. Cl. ..... 313/477 HC; 313/495

(58) Field of Classification Search ..... 313/49–51, 313/495, 477 HC

See application file for complete search history.

(56) References Cited

U.S. PATENT DOCUMENTS

| | | | | |
|---|---|---|---|---|
| 5,186,849 | A | 2/1993 | Toya et al. | 508/172 |
| 6,603,255 | B1 * | 8/2003 | Takahashi | 313/496 |
| 6,858,980 | B1 * | 2/2005 | Kamiguchi | 313/495 |
| 2003/0122472 | A1 * | 7/2003 | Kawase | 313/422 |

FOREIGN PATENT DOCUMENTS

| | | |
|---|---|---|
| JP | 04-106861 | 4/1992 |
| JP | 7-78577 | 3/1995 |
| JP | 200195449 A * | 7/2000 |

* cited by examiner

*Primary Examiner*—Ashok Patel
(74) *Attorney, Agent, or Firm*—Fitzpatrick, Cella, Harper & Scinto

(57) ABSTRACT

This application discloses an anode-terminal cover for covering an anode-electrode terminal of a display and a display using the same. In particular, this anode-terminal cover includes an insulating body and a conductive contact portion disposed in part of the insulating body being in contact with the display during the mounting of the anode-terminal cover on the display.

7 Claims, 3 Drawing Sheets

ANODE-TERMINAL COVER AND DISPLAY HAVING THE SAME

BACKGROUND OF THE INVENTION

1. Field of the Invention

The present invention relates to an anode-terminal cover covering an anode terminal of a display having an anode, and relates to a display having the anode-terminal cover, the display being for use in displaying characters or images of television receivers and computers, etc.

2. Description of the Related Art

In a CRT (cathode-ray tube), it has been known that a connection portion between an anode electrode and a connection terminal connected to a voltage-feeder line is covered with a sucker-like anode cover entirely made of an insulating material so as to prevent the connection portion, to which high voltage is applied, from dust adhesion and water immersion, resulting in suppressing electric discharge (Japanese Patent Laid-Open No. 4-106861).

SUMMARY OF THE INVENTION

It is an object of the present application to provide a new anode-terminal cover and a display using the same capable of achieving stable voltage application.

An anode-terminal cover according to a first aspect of the present invention for covering an anode-electrode terminal of a display comprises an insulating body and a conductive contact portion disposed in part of the insulating body so as to be in contact with the display during the mounting of the anode-terminal cover on the display.

Preferably, the insulating body and the conductive contact portion are commonly made of an elastic material so as to be a sucker-shaped structure.

Preferably, the insulating body and the conductive contact portion are integrally formed by two-color injection molding. Wherein the two-color injection molding is not limited to materials with colors different from each other but it may include the injection molding using a plurality of different materials.

Preferably, the insulating body is made of an elastic material while the conductive contact portion is formed of a flexible conductive film so as to be a sucker-shaped structure.

Preferably, the conductive contact portion is a film of conductive paste.

According to the first aspect described above, preferably, the conductive contact portion is annularly formed along the entire periphery of the internal surface of the anode-terminal cover.

A display according to a second aspect of the present application comprises an electron emission unit; an anode electrode, to which an electric potential for accelerating an electron emitted by the electron emission unit is applied; an anode-electrode terminal for feeding the electric potential to the display; and an anode-terminal cover according to claim 1 for covering the anode-electrode terminal.

According to the present invention, preferably, the conductive contact portion of the anode-terminal cover is defined to have a constant electric potential in a state that the conductive contact portion is in contact with the display. Also, preferably, the conductive contact portion is defined to especially have the ground potential.

Also, preferably, the conductive contact portion of the anode-terminal cover is in contact with an electrode provided in the display.

Further objects, features and advantages of the present invention will become apparent from the following description of the preferred embodiments with reference to the attached drawings.

DESCRIPTION OF THE PREFERRED EMBODIMENTS

The present invention will be further described below with reference to the drawings. Since to an anode-electrode terminal covered with an anode cap, which is an anode cover, or a terminal area, a high-voltage is applied, electric potential distribution is produced not only in a portion covered with the anode cap but also in the peripheral portion thereof which must have the ground potential in itself. Therefore, there is a problem that the voltage application to an anode electrode is liable to be unstable because of electric discharge due to dust adhesion and water absorption to the periphery of the anode cap. A specific structure capable of solving this problem will be described below in detail.

First, an anode cover according to an embodiment will be described with reference to FIGS. 1 and 2.

Figure 1:
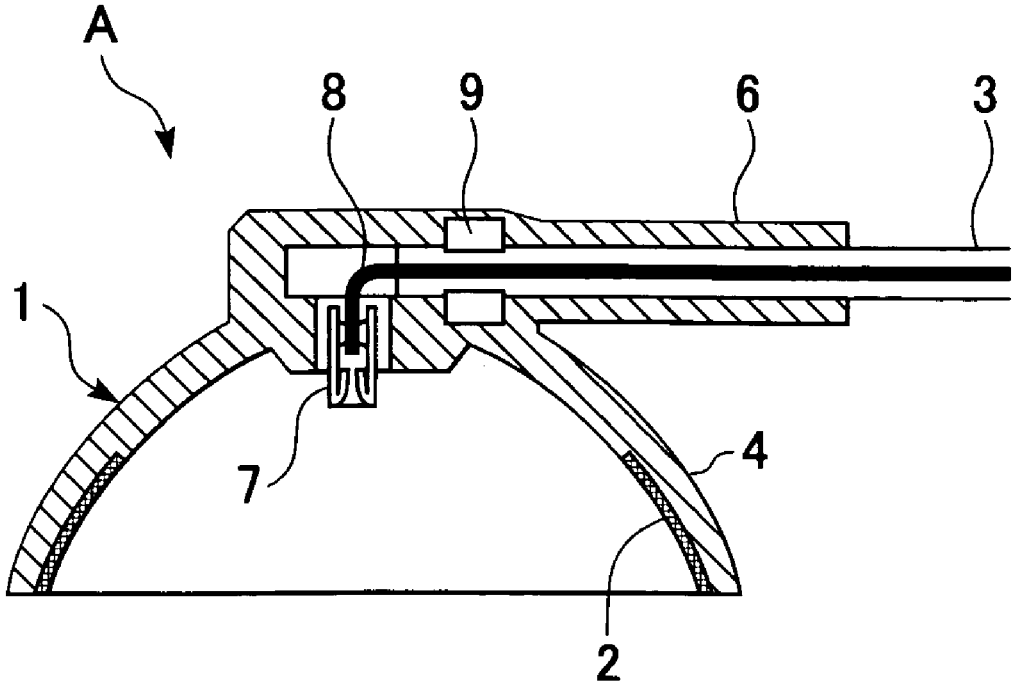
FIG. 1 is a longitudinal sectional view of an example of an anode cover according to the present invention.
Figure 2:
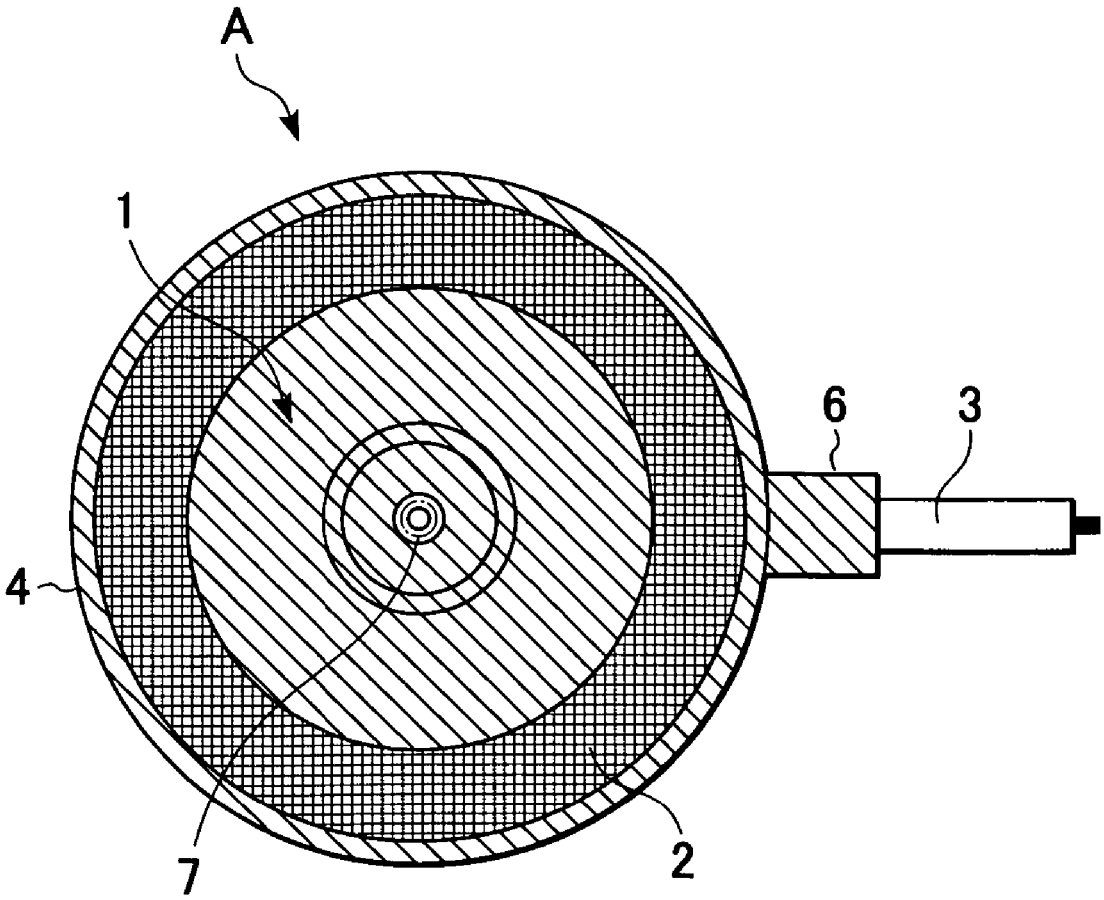
FIG. 2 is a bottom plan view of the anode cover shown in FIG. 1.

FIG. 1 is a longitudinal sectional view of an example of the anode cover according to the embodiment; and FIG. 2 is a bottom plan view thereof.

Referring to the drawings, an anode cover A is composed of an insulating body 1 made of an insulating material and a conductive contact portion 2 made of a conductive material and disposed in part of the insulating body 1.

The insulating body 1 constitutes principal part of the anode cover A, and the material thereof may be preferably excellent in the electric insulation. Specifically, it is preferable that the volume resistivity be $1.0\times10^{9}$ $\Omega/m^2$ or more so as to be resistible to the high-voltage applied by a voltage-feeder line 3, which will be described later. The upper limit of this volume resistivity is not especially limited; it is generally about $1.0\times10^{14}$ $\Omega/m^2$.

The conductive contact portion 2 is located at a position being in contact with a display B (see FIG. 3) when the anode cover A is attached to the display B, so that a sufficiently electrically conductible material is used therefor in comparison with that of the insulating body 1. Specifically, it is preferable that the volume resistivity be $1.0\times10^{6}$ $\Omega/m^2$ or less.

Any of the materials of the insulating body 1 and the conductive contact portion 2 may be a hard material (for the insulating body 1, a hard synthetic resin or ceramics, and for the conductive contact portion 2, a metallic plate, for example); however, it is preferable that the both be integrally made as an elastic sucker-like anode cover A because of the easiness in putting on and taking off the anode cover A. The elastic material for the insulating body 1 may be silicone rubber or chloroprene rubber, and the elastic material for the conductive contact portion 2 may be silicone rubber or chloroprene rubber having conductive filler mixed therein, for example.

The sucker-like anode cover A formed of both the materials of the insulating body 1 and the conductive contact portion 2 can be easily manufactured by two-color injection molding as an integrally molded piece. Specifically, after injecting the material for the insulating body 1, the material for the conductive contact portion 2 is injected at a predetermined position so as to readily obtain the integrally molded piece.

The sucker-like anode cover A may also be obtained by forming the insulating body 1 of the above-mentioned elastic material while forming the conductive contact portion 2 of a flexible conductive film. The flexible conductive film can be formed as a coating film of conductive paste. In the case where the conductive contact portion 2 is formed as the coating film of conductive paste, after forming the insulating body 1 by general injection molding equipment, the conductive contact portion 2 can be enough formed only if an attachment for the conductive contact portion 2 is arranged, having an advantage of simplified injection molding equipment.

The anode cover A shown in the drawings is composed of the inverted-cup like insulating body 1 and the conductive contact portion 2 annularly formed along the entire periphery of the internal surface of the insulating body 1, and both the insulating body 1 and the conductive contact portion 2 are made of an elastic material. The anode cover A is in a sucker shape capable of sticking fast on a pushing surface of the display B by pushing the anode cover A to the display B (see FIG. 3) so as to elastically expand and flatten a sidewall 4 of the anode cover A outwardly. The conductive contact portion 2 is arranged at a position being in contact with the display B when the anode cover A is absorbed to the display B. The position of the display B being in contact with the conductive contact portion 2 is the periphery of an anode electrode terminal 5 (see FIG. 3), which will be described later; alternatively, it may be any of a casing surface of the display B, a component surface of the display B, and a surface of a component added to the display B.

The thickness of the apex of the insulating body 1 is larger than that of the sidewall 4, and on one side thereof, a tubular voltage feeding-line insertion section 6 is extending. A space within the voltage feeding-line insertion section 6 bends inwardly at the apex of the insulating body 1 and is opened to the internal surface of the apex.

The anode cover A is used by connecting the voltage-feeder line 3 thereto, which is attached to the end thereof with a soldering portion 8 therebetween. The connection of the voltage-feeder line 3 is performed by inserting the end portion of the voltage-feeder line 3 into the voltage feeding-line insertion section 6 after fitting a split-annular stopper 9 into the end portion of the voltage-feeder line 3 and also by allowing a connection terminal 7 to oppose apex both sides of the insulating body 1.

Next, the above-mentioned display having the anode cover will be described with reference to FIG. 3.

Figure 3:
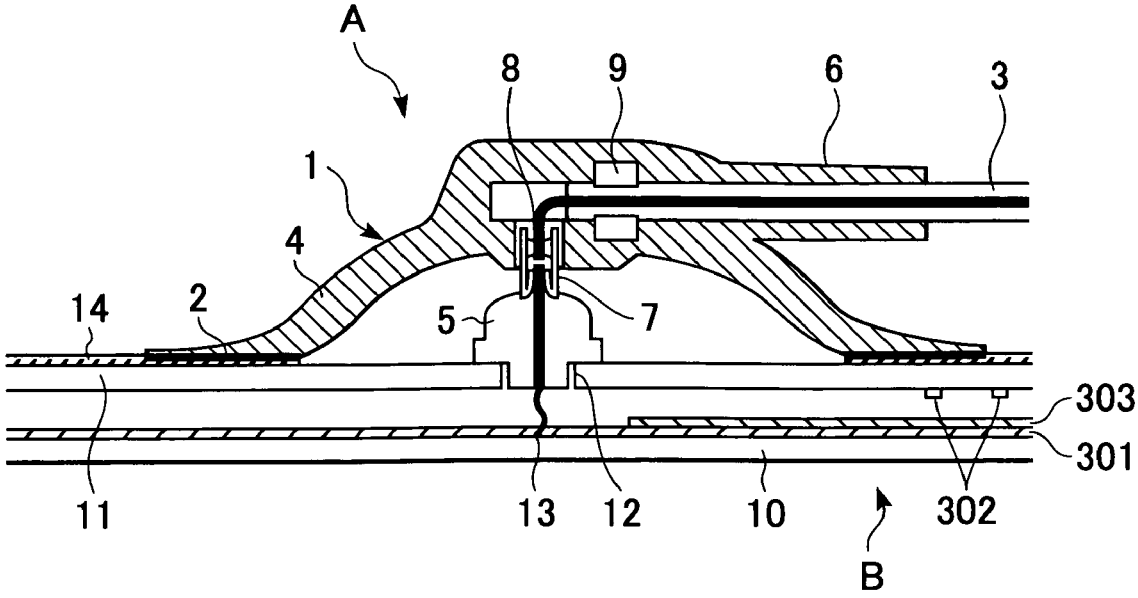
FIG. 3 is a partially sectional view of an example of a display having the anode cover according to the present invention.

FIG. 3 is a partially sectional view of an example of the display having the anode cover. In FIG. 3, like reference characters designate like components or sections common to FIGS. 1 and 2.

Referring to FIG. 3, a panel display B includes a front glass plate 10 having an anode electrode 301 and a phosphor 303 formed on the internal surface and a back glass plate 11 spaced to oppose the front glass plate 10 with a frame bar therebetween and having electron emission elements constituting an electron emission unit 302, so that the interior is sealed with vacuum ambience by evacuating inside air.

The back glass plate 11 has a hole 12 with a diameter of about 10 mm formed thereon and the hole 12 is sealed with the anode electrode terminal 5 which is in an outward intruding state. Also, the anode electrode terminal 5 is connected to an anode electrode 01 of the front glass plate 10 via a spring electrode 13.

The anode cover A is absorbed to the back glass plate 11 in a state that the connection terminal 7 is inserted into and connected to the anode electrode terminal 5 and the skirt of the anode cover A is pushed to the periphery of a connection portion (the connection terminal 7 and the anode electrode terminal 5), so as to cover the connection portion. Therefore, the voltage fed from the voltage-feeder line 3 is to be applied to the anode electrode 301 from the spring electrode 13 via the connection terminal 7 covered with the anode cover A and the connection portion of the anode electrode terminal 5.

In the periphery of the anode electrode terminal 5 of the back glass plate 11, a grounded ground electrode 14 is provided, and the conductive contact portion 2 of the anode cover A is connected to the ground electrode 14.

Upon applying a voltage to the anode electrode 301 from the voltage-feeder line 3, since it is generally the high voltage, a leakage current is produced, generating a potential gradient in the vicinity of the connection portion. According to the embodiment, since the conductive contact portion 2 of the anode cover A is connected to the grounded ground electrode 14, there are a route of the leakage current from the connection terminal 7 to the ground via the insulating body 1 and the conductive contact portion 2, which are located in the vicinity, and a route from the connection terminal 7 to the ground via the anode electrode terminal 5, the back glass plate 11, and the conductive contact portion 2. Since the leakage current flows from the conductive contact portion 2 to the ground if any of the routes is taken, the produced potential gradient falls within the anode cover A, preventing the potential gradient from being produced outside the anode cover A. Therefore, dust adhesion and water absorption due to the potential gradient produced outside the anode cover A can be prevented, enabling the voltage applied to the anode electrode to be stabilized by suppressing electric discharge due to the dust and the water.

Owing to the conductivity applied to the skirt edge of the anode cover along the entire periphery thereof, by supplying a predetermined potential (preferably ground potential) at least to any position of the skirt edge of the anode cover, the potential of the entire skirt periphery is substantially defined, so that even if part of the anode cover skirt is not in contact with the display, the potential of the entire periphery of the anode cover can be securely defined. That is, in the anode cover covering the connecting portion between the anode electrode terminal of the display and the connection terminal connected to the voltage-feeder line, by using the anode cover characterized in that the conductive portion is provided along the entire periphery of the skirt edge contacting the display, the preferable potential of the anode cover can be defined. In a state that the anode cover is attached to the display having the anode electrode terminal in particular, by providing supplying means for supplying a predetermined potential to a portion of the anode cover skirt having conductivity (an electrode provided in the display having the anode cover to be attached thereto, preferably), the display capable of preferably defining the potential of the anode cover can be achieved.

According to the embodiment described above, the potential of the conductive contact portion 2 is defined as the ground potential; alternatively, it may be defined as a potential other than the ground potential within the scope capable of suppressing the potential gradient generation outside the anode cover A. However, from the viewpoint that the potential gradient generation is simply and securely suppressed outside the anode cover A, it is preferable that it be defined as the ground potential. Also, according to the embodiment, the potential definition of the conductive contact portion 2 is performed by bringing the conductive contact portion 2 in contact with the ground electrode 14 disposed in the display B; alternatively, if the anode cover A is provided with a potential-definition line, the potential of the conductive contact portion 2 can be defined as constant through the potential-definition line. Specifically, by providing a ground wire connected to the conductive contact portion 2 in the anode cover A, the potential of the conductive contact portion 2 can be maintained at the ground level.

According to the configurations described above, the conductive contact portion 2 capable of defining the potential can set the potential definition within the anode cover A. Thereby, dust adhesion and water absorption due to the potential gradient produced outside the anode cover A can be prevented. Also, by suppressing electric discharge, the voltage applied to the anode electrode is stabilized, so that images on the display can be stabilized for a long period of time.

As is understood from the above description, by a terminal cover according to the present invention, the stable potential application and the stably operating display can be achieved.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image display apparatus comprising:

a display comprising:

an electron emission unit;

an anode electrode, to which an electric potential for accelerating an electron emitted by the electron emission unit is applied;

an anode-electrode terminal for feeding the electric potential to the display apparatus; and a first electrode sitting on a periphery of the anode-electrode terminal; and an anode-terminal cover contacting to the display and covering the anode-electrode terminal, wherein said anode-terminal cover comprises:

an insulating body; and a conductive portion which is annularly positioned on the insulating body and contacts the first electrode, and a predetermined potential is applied to the first electrode and the conductive portion.

2. An image display apparatus according to claim 1, wherein the anode-terminal cover is sucker-shaped, and the insulating body and the conductive portion are commonly made of an elastic material.

3. An image display apparatus according to claim 1, wherein the insulating body and the conductive portion are integrally formed by two-color injection molding.

4. An image display apparatus according to claim 1, wherein the anode-terminal cover is sucker-shaped, and the insulating body is made of an elastic material while the conductive portion is formed of a flexible conductive film.

5. An image display apparatus according to claim 1, wherein the conductive portion is a film of conductive paste.

6. An image display apparatus according to claim 1, wherein the conductive portion is annularly formed along the entire periphery of the internal surface of the anode-terminal cover.

7. An image display apparatus according to claim 1, wherein the predetermined potential is a ground potential.

* * * * *

UNITED STATES PATENT AND TRADEMARK OFFICE

CERTIFICATE OF CORRECTION

PATENT NO. : 7,049,737 B2
APPLICATION NO. : 10/726548
DATED : May 23, 2006
INVENTOR(S) : Kinya Kamiguchi It is certified that error appears in the above-identified patent and that said Letters Patent is hereby corrected as shown below:

ON THE TITLE PAGE

Item (56), Foreign Patent Documents, "200195449" should read --2000-195449--.

Signed and Sealed this

Nineteenth Day of December, 2006

JON W. DUDAS

*Director of the United States Patent and Trademark Office*